United States Patent [19]

Siegel

[11] 4,200,055

[45] Apr. 29, 1980

[54] TROLLING DRIVING MEANS FOR BOAT

[75] Inventor: Dale Siegel, Sauk Rapids, Minn.

[73] Assignee: Hydra-Troll, Inc., Fergus Falls, Minn.

[21] Appl. No.: 972,038

[22] Filed: Dec. 21, 1978

Related U.S. Application Data

[63] Continuation of Ser. No. 790,188, Apr. 25, 1978, abandoned.

[51] Int. Cl.[2] ..... B63H 5/13

[52] U.S. Cl. ..... 115/18 A

[58] Field of Search ..... 115/17, 18 R, 18 A, 115/18 E, 34 R, 34 A, 35, 37, 38, 76, 6.1; 74/664, 665 R, 665 F, 665 G, 665 T; 192/84 A

[56] References Cited

U.S. PATENT DOCUMENTS

| | | | |
|---|---|---|---|
| 2,691,784 | 10/1954 | Eckl | 115/6.1 |
| 3,010,422 | 11/1961 | Brakensiek | 115/34 R |
| 3,136,284 | 6/1964 | North | 115/35 |
| 3,139,853 | 7/1964 | McCarthy et al. | 115/18 A |
| 3,601,980 | 8/1971 | Faber | 115/37 |
| 3,709,186 | 1/1973 | Gotmalm | 115/34 A |
| 3,917,042 | 11/1975 | Summa | 192/84 A |

*Primary Examiner*—Trygve M. Blix
*Assistant Examiner*—Jesus D. Sotelo
*Attorney, Agent, or Firm*—Leo Gregory

[57] ABSTRACT

This invention relates to a trolling propeller in connection with an inboard-outboard type of boat in which the improvement consists of mounting the trolling propeller onto the main propeller assembly without requiring any adjustment of the relative positions of the main and trolling propellers with respect to the boat and in utilizing the main power source to drive a main propeller or to drive the trolling propeller.

8 Claims, 4 Drawing Figures

10
12
14
16
18
20
21
23
25
26
28
30
32
35
36
37
46
49
50
52
54
60
62
66
67
69

RES.
VALVE
PUMP
ENGINE
REVERSE
FORWARD
N
TOR.
REV.
SPEED
8
18
30
32
35
35a
36
36a
37
46
47
49
54
55
56
62
65
66
67
70
71
72
73
74
75
80
82
83
84
90
93
93'
94
94a
94b
95
97
100

16
50
20
23
21
52
56
59
28
57
26
18
60
44
42
69
43
30
71
62
46
47
49
32
70
74
72
67
R
N
F
66
73
65
75

10
12
14
16
18
20
21
23
25
26
28
30
32
42
43
46
47
49
54
55
56
62
65
67
69
70
71
72
73
74
80
82
84
90
93
94a
94b
100

TROLLING DRIVING MEANS FOR BOAT

CROSS REFERENCE TO RELATED APPLICATION

This application is a cont. of S.N. 790,188 filed 4-25-77, which was abandoned on Aug. 17, 1978.

BACKGROUND AND SUMMARY OF THE INVENTION

It is desirable to have means in connection with an inboard-outboard type of boat to propel the boat at a speed slow enough to be suitable for fishing as by trolling and the same is referred to as a trolling speed.

It is not desirable to attempt to slow down a power unit in a boat designed for traveling speeds to a slow speed such as for trolling purposes.

The following reference material is cited as being representative of the development of art which is known. In U.S. Pat. No. 3,756,186 an auxiliary motor is used by exchanging positions with the main power unit. In U.S. Pat. No. 3,881,443 a small electric motor powered propeller is lowered into the water to drive the boat for fishing purposes. In U.S. Pat. No. 3,596,625 a pair of auxiliary motors are mounted upon the transom of a boat to drive trolling propellers. In U.S. Pat. No. 2,504,833 a smaller power source is used to drive the main propeller in place of the main power source, for fishing purposes. In U.S. Pat. No. 3,139,853 an auxiliary motor is mounted upon the cavitation plate of the main motor and utilizes a separate power source for propulsion. In U.S. Pat. No. 3,587,512, a shaft is lowered into the water carrying a unit to propel a boat at fishing speeds. In U.S. Pat. No. 3,601,980 a hydrofoil is disclosed having an auxiliary power source to drive an auxiliary propeller to attain lower speeds. Here separate engines are used and may be coupled to drive the main propeller and there is no simple control member which selectively causes either the main propeller or the auxiliary propeller to be powered to drive the boat.

The structure disclosed and claimed herein represents substantial improvement in providing a trolling propeller mounted in position for operation without requiring any change of position of itself or of the main propeller with respect to the boat and in utilizing the main power source through driving means reducing the power output for suitable operation of the trolling propeller at a fishing speed.

It is an object of this invention to provide a trolling propeller as an attachment to a main propeller assembly for a selective independent operation as an alternative to the main propeller without any manual change of the positions of the propellers.

It is another object of this invention to provide means for operating a boat at trolling speeds utilizing the main power source and not requiring a relative change in position of the main propeller with respect to the boat.

It is a further object of this invention to provide in connection with an inboard-outboard type of motor boat a trolling propeller carried by the main propeller assembly without requiring any relative adjustment of the positions of each other and to utilize selectively in the alternative with the main propeller, the main power source.

It is more specifically an object of this invention to provide a trolling propeller removably attached to a main propeller assembly and having power transmission means connected to the main power source for use selectively of said main power source for propulsion in the alternative with the main propeller and in operation requiring no relative adjustment as to position of the trolling propeller or the main propeller.

These and other objects and advantages of the invention will be set forth in the following description made in connection with the accompanying drawings in which like reference characters refer to similar parts throughout the several views and in which:

FIG. 1 is a view in longitudinal vertical section with a portion being broken away;

DESCRIPTION OF A PREFERRED EMBODIMENT

Figure 2:
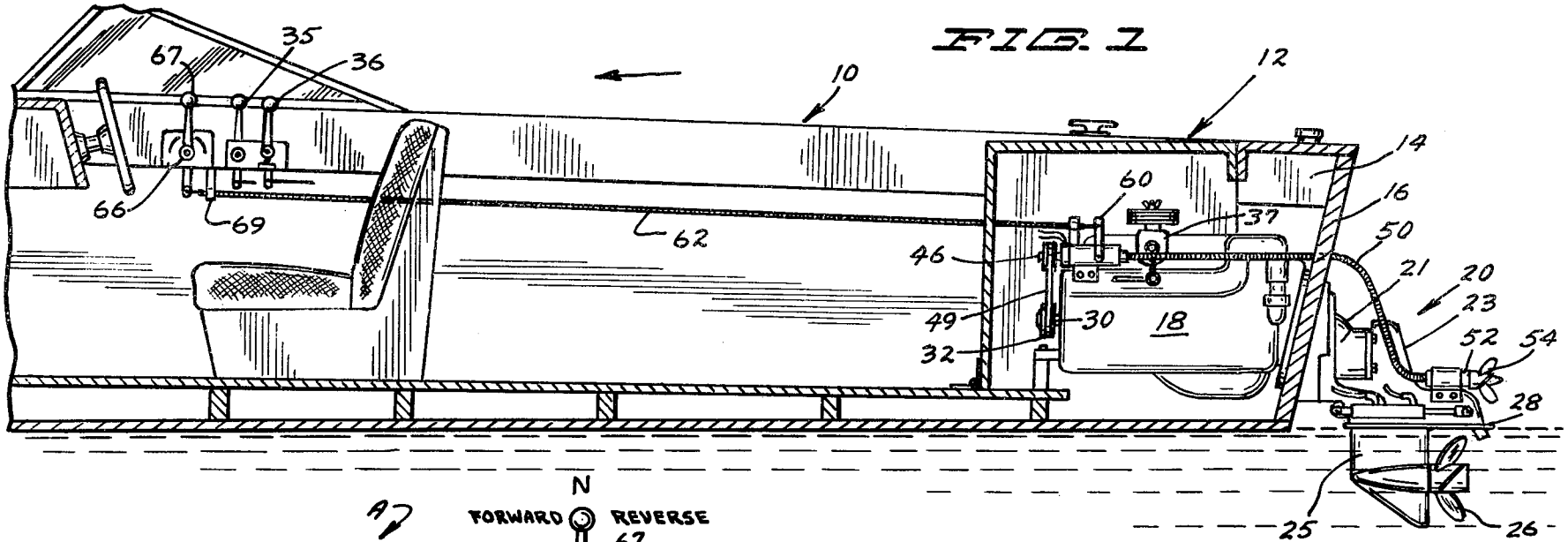
FIG. 2 is a fragmentary view on an enlarged scale in vertical section.

Referring to FIGS. 1 and 2, a boat is indicated generally by the reference numeral 10 and is shown as an inboard-outboard type of motor boat comprising a hull 12 having mounted in the stern 14 thereof adjacent the transom 16 a primary power means or power source 18 of a conventional marine type of engine such as of an internal combustion engine.

Mounted at the outer side of said transom 16 is a stern driving means or main propeller assembly 20 comprising a gimbal housing portion 21 which comprises an upper portion 23 and a lower portion 25 with said lower portion carrying a main propeller 26. Spaced above said propeller and intermediate said upper and lower portions is a cavitation plate 28. Said primary power means will have conventional linkage not here shown running to said propeller 26 and the connection of said linkage with said primary power means will be mechanically controlled by a control member 36 to be described.

Said power means will be operated by control members 35 and 36 which will be connected thereto for operation in a known and conventional manner not here shown. Said control 35 is a speed control lever or arm running to a carburetor 37 to operate the throttle valve thereof. Said control 36 is a transmission shifting lever or arm for connecting the transmission of said power means with the linkage of said main propeller 26 for forward and reverse movement and when said control 36 is in neutral position said power means is operatively disengaged from said linkage of said main propeller. This represents conventional structure.

Extending from said power means 18 is a shaft 30 having a pulley 32 mounted thereon.

There will now be described the subject matter of the invention comprising a trolling propeller 54 and related control structure to be used selectively in the alternative to the propeller 26 to propel the boat at a relatively slow speed for fishing purposes.

Mounted onto the block of the engine 18, as illustrated, by a bolted bracket 42 is a clutch mechanism or member 43 of a conventional structure which is merely indicated here and not shown as to detail and which for purpose of illustration is indicated as being an electromagnetic clutch and in connection therewith is a shaft 46 extending therefrom carrying a pulley 47 which is connected to said pulley 32 by a belt 49 passing thereover whereby said shaft 46 is driven by said shaft 30 and is in driving connection with the power means 18.

Said clutch mechanism is shown here only as a housing and the same is in operating engagement with a gear means 44 forming a shifting gear train or transmission of conventional design which is here shown merely as a housing which is integral with said clutch housing 43 and said gear means has connected thereto a flexible cable 50 (generally known as a Bowden Wire) which extends through the transom 16 to said trolling propeller 54 which is carried in a bearing housing 52 secured by a bracket 56 and bolts 57 to the upper portion 23 of the gimbal housing and is spaced just above the cavitation plate 28 as shown, said spacing for purposes herein may be on the order of three or four inches.

Extending outwardly of said gear means 44 is an operating or shifting lever 60 which operates the driving arrangement of said gear train responsive to the action of a cable 62 which connects it to a lever arm 65 mounted onto and carried by an electrical control panel 66 which carries a manually operable shifting or operating arm 67 which arm operates the lever arm 65. Said cable is supported by appropriate guides 69. Said panel 66 and the shifting arm 67 will be located in the boat as illustrated at a place convenient to the operator of the boat. In connection with the shifting arm 67 is the indicia F - N - R which indicates the positioning of said shifting arm to place the gear means 44 in forward drive, neutral or rearward drive operating positions.

Figure 4:
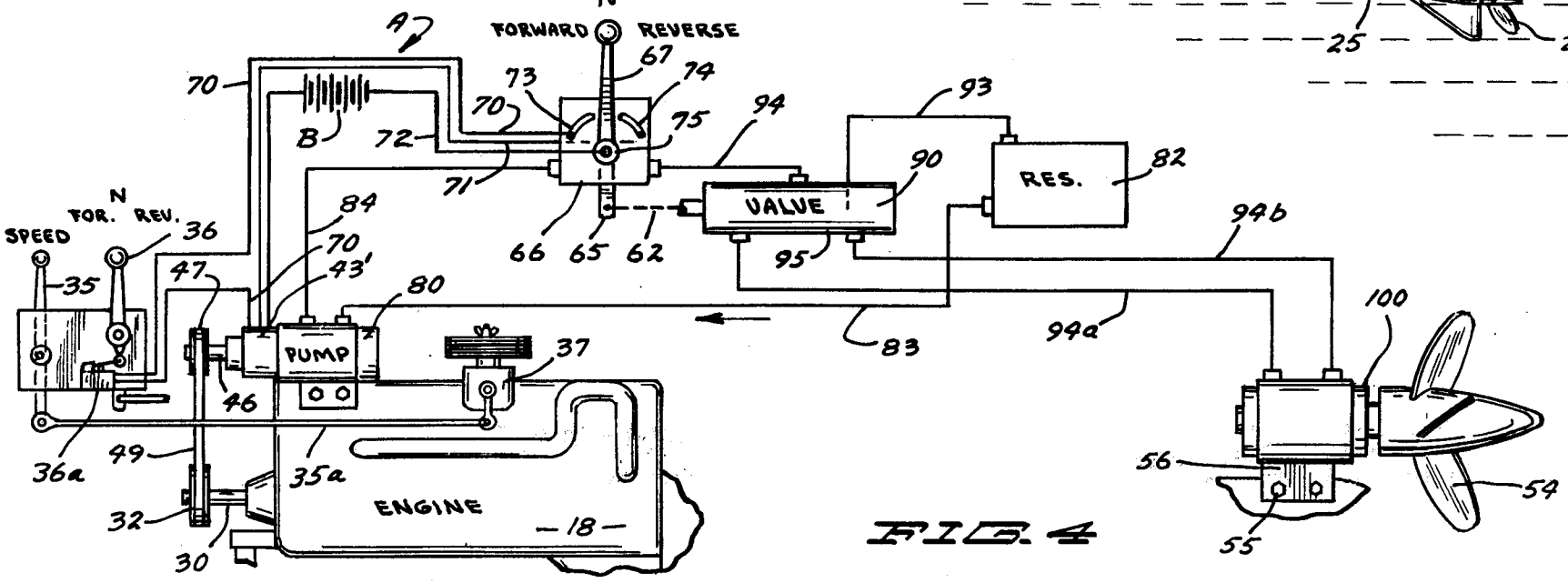
FIG. 4 is a schematic showing of the structure of FIG. 3.
Figure 2:
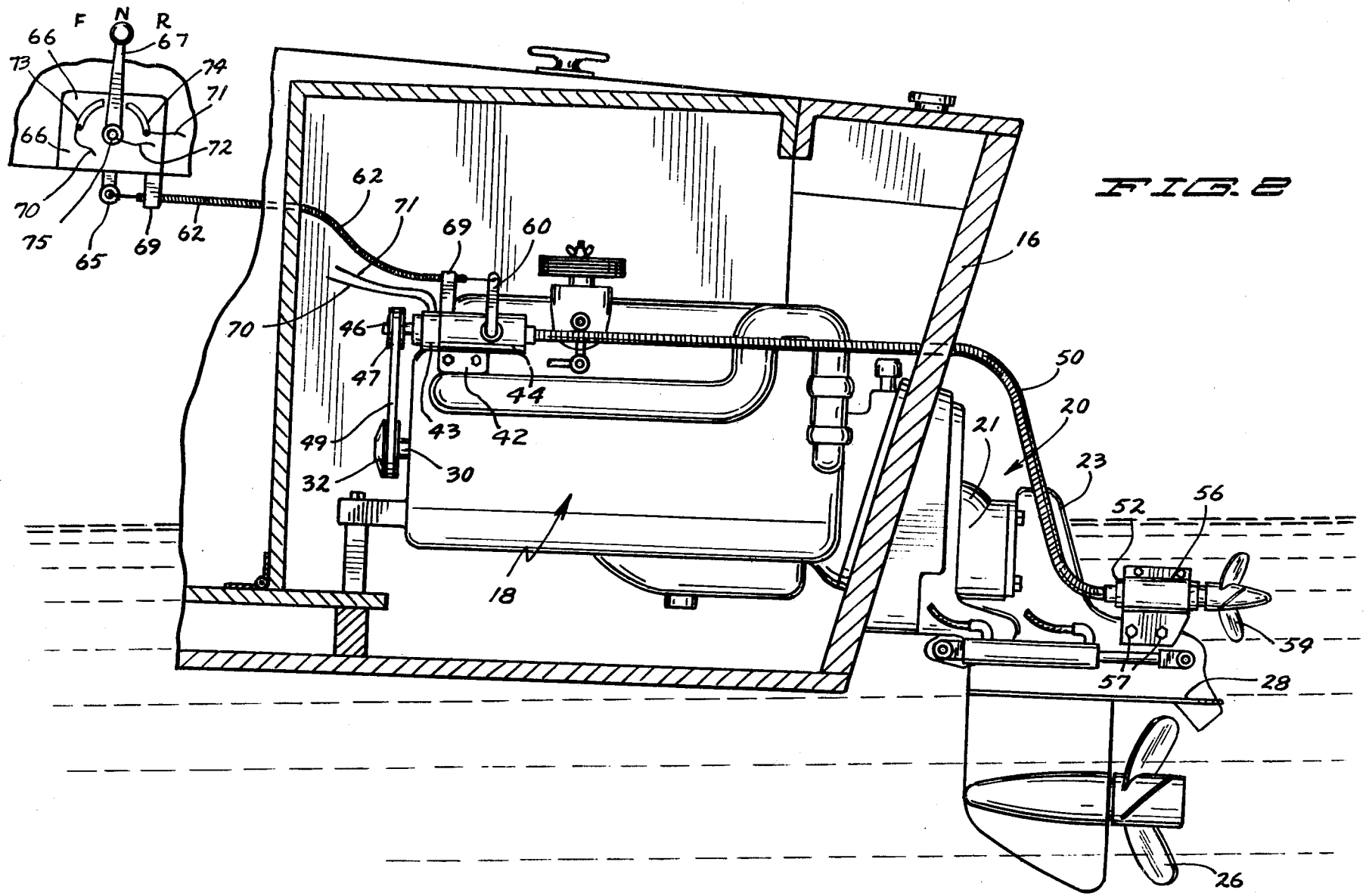

In a circuit, which is illustrated in FIG. 4 as circuit A but which also applies to the structure of FIGS. 1 and 2, there is shown included with said clutch 43 the electric wires or lines 70 and 71 running to contacts 73 and 74 carried by the panel 66 for engagement by the shifting arm 67 and running from said shifting arm is a common hot line 72 which will run to a current source shown as a battery B in FIG. 4. The wiring is conventional in connection with an electrical system of a boat. It is thus seen that the shifting arm 67 in either forward or reverse positions energizes the clutch mechanism 43 to be in driving engagement with the shaft 46 and at the same time the shifting arm 67 shifts the operating lever 60 to place the gear train 44 in a corresponding driving position, either forward or rearward.

It will be noted that the circuit A includes a microswitch **36*a* which is positioned for engagement by the control arm 36 when said arm is in neutral position, which engagement places the shifting arm 67 in current with a current supply from the current source B whereby when in forward or reverse positions, said arm 67 energizes and operates the clutch member 43. It is seen that the power source or engine 18** can be utilized selectively to drive either the main or trolling propeller but not both.

Thus the shifting arm 67 and its related structure extending to the trolling propeller forms a driving means from the main power source or engine 18 to said trolling propeller independently of and in the alternative to the driving means present to drive the main propeller.

In operation, when the boat 10 is traveling under the power of the main propeller 26, the cavitation plate 28 will be riding in the plane of the surface of the water and the trolling propeller 54 will be above the water surface.

When it is desired to use the boat for trolling purposes, the operating lever 36 for the main propeller 26 will be placed in neutral position to disengage the main propeller from the main power source 18. With the boat at rest or moving at trolling speeds, the stern portion of the hull will be sufficiently under water to submerge the trolling propeller which is mounted just a few inches above the cavitation plate. The operator by means of the shifting arm 67 will engage the clutch mechanism 43 with the drive shaft 46 and thus a driving connection will be completed through the flexible cable 50 to the trolling propeller 54. The shifting arm 67 as above described not only operates the clutch member but simultaneously operates the gear train or transmission 44 for a driving connection with the trolling propeller 54 either in a forward or rearward direction.

Thus the boat 10 is maintained at a trolling speed by operation of the propeller 54 without any relative adjustment of the positions of either the trolling propeller or the main propeller 26. The speed of which the boat is traveling will determine the position of the trolling propeller 54. At trolling speed the trolling propeller will be submerged for operation. At a normal traveling speed with the boat planing driven by the propeller 26, the trolling propeller 54 will be above the water surface and in an inoperative position and will not impede the operation of the propeller 26.

The main power source as described is used selectively in the alternative to drive the main propeller or the trolling propeller and the respective propellers are in operating position without any relative change of their respective positions being required. There is no provision by which both propellers can be driven at the same time.

It will be understood that it is within the scope of the invention herein to have the shaft 46 in direct driving connection with the gear train 44 and the trolling propeller becomes operative upon the shifting arm 67 being positioned in forward or reverse positions.

MODIFICATION

Figure 3:
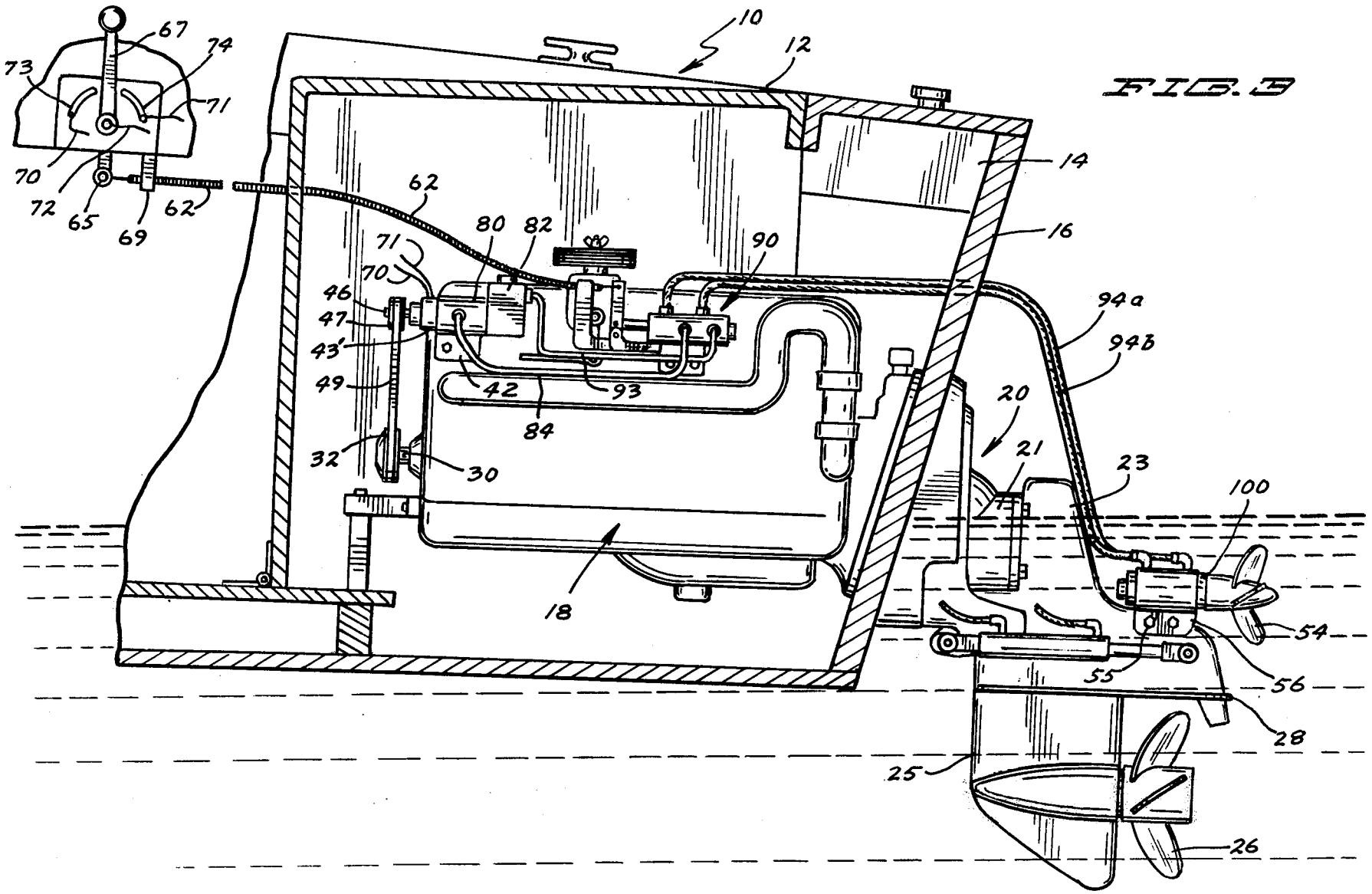
FIG. 3 is a view similar to FIG. 2 showing a modification.

Referring now to FIGS. 3 and 4, a modification of the structure above described is shown in which like parts are indicated by like reference numerals and will not be further described. Modified parts are indicated by like reference numerals with a prime added.

In lieu of the mechanically operated control linkage between the clutch mechanism 43 and the trolling propeller 54, a hydraulic system is substituted.

Thus instead of a mechanical gear train or transmission and housing 44, a hydraulic pump 80 is substituted and is integral with the clutch mechanism 43' in a conventionally designed structure and also integral with the pump 80 is a reservoir housing or reservoir 82. The clutch mechanism 43 and 43' are identical in operation.

In FIG. 3 a hydraulic line 84 is shown running from the pump 80 to a hydraulic spool valve 90 and a return line 93 is shown running to the reservoir 82. In the schematic drawing of FIG. 4 a line 83 is shown running from the pump 80 to the reservoir 82 but in fact the pump and reservoir are integral and the line 83 will represent a port and is shown in FIG. 4 for purpose of illustration.

The spool valve 90 is shown having neutral (N), forward (F) and rearward (R) ports for determining the direction of the rotation of the trolling propeller 54 and the direction of travel of the boat 10.

Instead of a bearing housing 52 as shown in FIG. 2, there is substituted a hydraulic motor 100 to which run the lines **94*a* from the valve 90 for motion in a forward direction and the line 94*b* from the valve 90** for motion in a rearward direction of travel.

The operation of the clutch mechanism 43' by the shifting arm 67 is the same as first above described and here in lieu of the arm 67 operating the lever arm 60 as described in connection with FIG. 2, the operating arm 67 by means of the flexible cable 62 operates a sliding valve control member 95 which either maintains the valve 90 in neutral position or directs the flow of hydraulic fluid through the forward or rearward directional ports in connection with the lines 94*a* and 94*b*.

As described in the previous embodiment of the invention herein, the shifting arm 67 may be used for operating the trolling propeller only when the main operating arm 36 is in a neutral inoperative position. The main and trolling propeller are not capable of being operated at the same time.

The main speed control arm 35 which is connected by linkage 35*a* to the throttle valve of the carburetor 37 is always in operative position determining the speed at which the main power source 18 will drive the shaft 30 as is customary in such operations. The carburetor may be equipped with a safety switch so that when the trolling propeller is being operated, the safety switch will limit the throttle valve if an effort is made to drive the trolling propeller at an excessive rate of speed. This is known in the art and is not here shown.

It is believed that the hydraulic system is readily understood as to its operation from the description above given and the operation of the boat is believed to be well understood from its operation first above given.

The apparatus described herein has been tested and found to operate very successfully. Substantial advantage has been gained by having the trolling propeller mounted in operating position in such a manner that it requires no relative change of position with respect to the main propeller nor does the main propeller require a relative change in position for operation of the trolling propeller. A great deal of convenience and economy is secured in the construction of the invention herein in utilizing by the linkage described, the main power source for operation of the trolling propeller selectively in the alternative to the main propeller.

Although not here shown, it is within the concept of this invention to embody flow control means in connection with the spool valve 90 as a speed regulation of the propeller 54 in lieu of the control member 35 and in connection with this the shaft 46 may be in constant driving engagement with the pump 80. This would in effect provide a mechanical-hydraulic system in lieu of an electrical-hydraulic system.

An essential element of novelty is present in the fool proof arrangement whereby only one propeller is capable of being driven at any one time from a single power source used selectively to drive one or the other of the propellers through the operation of a single control member which is capable of putting into operation only one of said propellers at a given time.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. In a boat comprising a hull having a single power source, an outboard propeller assembly including a main propeller and a trolling propeller assembly, having in combination said trolling propeller mounted in vertically spaced relation to said main propeller and being positioned and arranged to submerge when said main propeller is inoperative, said single power source being for both propellers, means for connection of said main propeller with said power source, means for connection of said trolling propeller with said power source, a control arm engaging only said first mentioned means with said power source when in one operating position and selectively engaging only said second mentioned means with said power source when in an alternate operating position, an electro-magnetic clutch member in connection with said second mentioned means, driving means connecting said power source and said electro-magnetic clutch member, an electric circuit in connection with said second mentioned means and including said electro-magnetic clutch member, a switch member and an electric current source, and said control arm closing said switch member when in alternate operating position putting said second mentioned means in circuit with said electric current source and energizing said electro-magnetic clutch member to interengage said second mentioned means and said power source.

2. The structure set forth in claim 1, wherein said second mentioned means comprises a control member moveable to forward and reverse operating positions in circuit with said switch member, gear means, means connecting said control member and said gear means, means connecting said gear means at one side thereof with said trolling propeller, said electro-magnetic clutch member connected with the other side of said gear means, and said control member simultaneously energizing said electro-magnetic clutch member and operating said gear connecting means to position said gear means to drive said trolling propeller in a direction in accordance with the directional operating position of said control member.

3. The structure set forth in claim 1, wherein said second mentioned means comprises a control member moveable to forward and reverse operating positions in circuit with said switch member, a hydraulic valve in circuit with a hydraulic pump, means connecting said control member and said hydraulic valve, means connecting said hydraulic valve with said trolling propeller, said electro-magnetic clutch member connected with said hydraulic pump, and said control member simultaneously energizing said electro-magnetic clutch member to drive said hydraulic pump and operating said hydraulic valve to drive said trolling propeller in a direction in accordance with the directional operating position of said control member.

4. The structure set forth in claim 1, wherein said second mentioned means comprises a control member moveable to forward and reverse operating positions in circuit with said switch member, gear means, an operating arm member carried by said gear means, a cable connecting said control member and said operating arm member, driving means connecting said gear means at one side thereof and said trolling propeller, said electro-magnetic clutch member connected with the other side of said gear means, and said control member simultaneously energizing said electro-magnetic clutch member to drive said gear means and operating said operating arm member carried by said gear means to position said gear means to drive said trolling propeller in a direction in accordance with the directional operating position of said control member.

5. The structure set forth in claim 4, wherein said last mentioned driving means comprises a rotating cable.

6. The structure set forth in claim 1, including a housing assembly including said main propeller, and means securing said trolling propeller to said housing to be vertically spaced above said main propeller.

7. The structure set forth in claim 3, including a housing assembly including said main propeller, a trolling propeller housing assembly mounted onto said main propeller housing assembly, said trolling propeller housing assembly including a hydraulic motor, means connecting said hydraulic motor of said housing assembly with said hydraulic valve, whereby said trolling propeller is driven by means of said hydraulic motor in a direction in accordance with the directional position of said control member.

8. The structure set forth in claim 2, including a panel mounted in said boat hull carrying said control member in circuit with said switch member, an arm member carried by said gear means operating the same, and a cable member connecting said control member and said arm member.

* * * * *